United States Patent [19]

Uncles

[11] 4,242,064

[45] Dec. 30, 1980

[54] ROTARY FLUID PUMP WITH ECCENTRICALLY MOVING PUMPING SLEEVE

[75] Inventor: Philip B. Uncles, Bradford-on-Avon, England

[73] Assignee: Moulton Developments Limited, Bradford-on-Avon, England

[21] Appl. No.: 6,771

[22] Filed: Jan. 26, 1979

[30] Foreign Application Priority Data

Jan. 26, 1978 [GB] United Kingdom ..... 03203/78

[51] Int. Cl.[3] ..... F04C 2/00

[52] U.S. Cl. ..... 418/66; 417/410

[58] Field of Search ..... 418/66, 67; 417/410

[56] References Cited

U.S. PATENT DOCUMENTS

| | | | |
|---|---|---|---|
| 2,018,515 | 10/1935 | Doeg | 418/66 |
| 2,084,444 | 6/1937 | Kosian | 418/66 |
| 2,512,765 | 6/1950 | Byram | 417/410 |
| 2,584,865 | 2/1952 | Gordinier | 418/66 |
| 2,635,550 | 4/1953 | Granberg | 417/410 |
| 3,969,044 | 7/1976 | Fussner et al. | 417/410 |

*Primary Examiner*—John J. Vrablik

*Attorney, Agent, or Firm*—Shoemaker and Mattare, Ltd.

[57] ABSTRACT

The invention relates to a rotary hydraulic pump comprising a housing defining a generally cylindrical pump chamber between axial end walls. The chamber is bounded radially by a mainly cylindrical wall interrupted by two recesses constituting inlet and outlet ducts of the chamber. A shaft passes axially through said end walls and the part of the shaft which is located within the chamber is constituted as a crank. A cylindrical pumping sleeve surrounds the crank and is adapted as the crank rotates to move eccentrically within the chamber and so that the external cylindrical surface of the pumping sleeve co-operates with the mainly cylindrical surface of the radial wall of the chamber whereby a crescent-shaped clearance between said surfaces rotates around the chamber and liquid introduced through the recess constituting the inlet duct is impelled around said chamber towards the recess constituting the outlet duct. Means is provided for preventing said sleeve from rotating as it moves eccentrically within said chamber.

7 Claims, 4 Drawing Figures

ROTARY FLUID PUMP WITH ECCENTRICALLY MOVING PUMPING SLEEVE

This invention relates to pumps and has for its object to provide a pump which can deliver relatively small volumes of liquid at high pressure; there being a requirement for such a pump in certain hydraulic levelling systems provided in the suspension of an automobile, to specify but one possible use.

This invention provides a rotary hydraulic pump comprising in combination a housing defining a generally cylindrical pump chamber between axial end walls, said chamber being bounded radially by a mainly cylindrical wall interrupted by two recesses constituting inlet and outlet ducts of the chamber, a shaft passing axially through said end walls with the part of the shaft which is located within the chamber being constituted as a crank, a cylindrical pumping sleeve surrounding the crank and adapted as the crank rotates to move eccentrically within the chamber and so that the external cylindrical surface of the pumping sleeve co-operates with the mainly cylindrical surface of the radial wall of the chamber whereby a crescent-shaped clearance between said surfaces rotates around the chamber and liquid introduced through the recess constituting the inlet duct is impelled around said chamber towards the recess constituting the outlet duct, and including means for preventing said sleeve from rotating as it moves eccentrically within said chamber.

Preferably the means preventing rotation of the pumping sleeve during its eccentric motion within the chamber comprises a tooth formed on the external surface of the pumping sleeve and which projects radially into that recess in the chamber wall which constitutes the outlet duct.

The tooth may also serve secondly to guide liquid from the chamber towards the outlet duct. Thirdly the tooth moving in the recess, as the sleeve oscillates, may perform a function resembling that of a one-way valve controlling flow of liquid to the outlet duct.

A non-return valve may be provided downstream of the outlet port. An inlet port is provided in the cylindrical wall of the pump chamber spaced radially from said recess such that liquid is caused to flow along a path extending through at least 270° around the wall of the chamber as it passes from the inlet port to the outlet port being impelled by the oscillatory movement of the sleeve within the chamber.

Preferably the tooth and the recess are so shaped that the tip of the tooth makes line contact with the "downstream" wall of the recess, the said downstream wall being that against which the tooth is pressed, by liquid pressure and by pressure arising from frictional forces generated by crank rotation and transmitted to the sleeve through an intervening bearing bush suitably of bronze.

Preferably there is interposed a bearing bush between the pumping sleeve and the crank to support relative rotation therebetween.

A pump incorporating such a pump chamber arrangement and with its crank driven at say 40 revolutions per second has been found suitable for generating pressures in excess of 450 $N/cm^2$ at liquid flows of less than 250 $cm^3$ per minute.

One embodiment of the invention is shown in the accompanying drawings in which:

FIG. 1 is a side view partly in cross section; while

Figure 1:
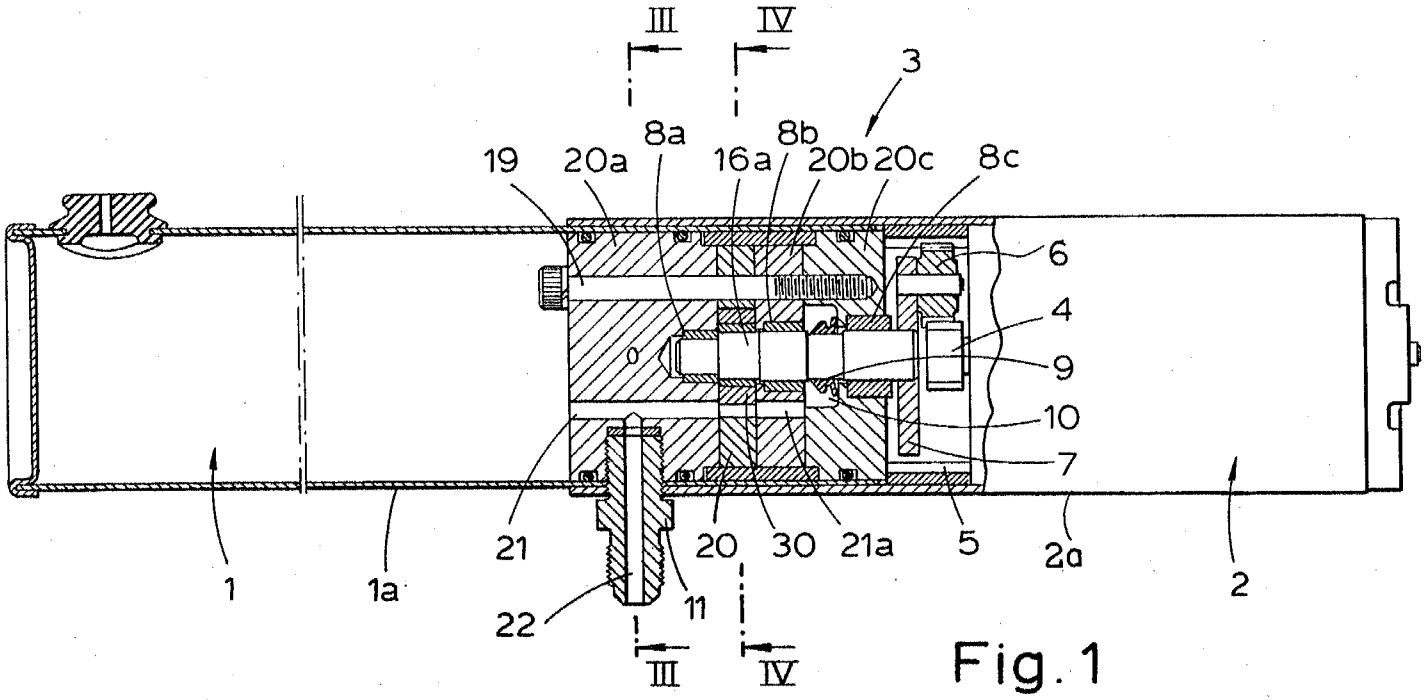

The pump shown in the drawings is a composite assembly including a liquid reservoir 1, shown on the left of FIG. 1, a small electric motor 2, shown on the right, and between these components a hydraulic pump assembly, generally designated 3.

The electric motor 2 has an outlet shaft on which is mounted a gear wheel 4. Surrounding the wheel 4 is a fixed gear ring 5 and interposed between these is a planet gear 6 carried rotationally upon a flywheel 7. A shaft 16 carries the flywheel 7 and the shaft 16 is supported by bearings 8*a*, 8*b* and 8*c* in a housing assembly to be described below. The gears 4, 5 and 6 constitute reduction gearing so that the electric motor 2 rotates the shaft 16 at a speed ratio of say 4.5:1 and so that for example a motor speed of 12,000 to 13,000 revolutions per minute results in a shaft speed of say 2,600 to 3,000 revolutions per minute.

The pump assembly 3 includes a housing assembly comprising a plurality of discs 20, 20*a*, 20*b* and 20*c* held together by bolts 19. The discs 20, 20*a*, 20*b* and 20*c* are located with a cylindrical sleeve 1*a* which also constitutes the wall of the reservoir 1. The sleeve 1*a* is entered within one end of a sleeve 2*a* which also constitutes the housing of the motor 2. The sleeve 1*a* and 2*a* are secured together by spigots 11 and 12 shown in FIGS. 2, 3 and 4.

The shaft 16 is supported for rotation, in the disc 20*a*, by the bearing 8*a*; in the disc 20*b*, by the bearing 8*b*; and in the disc 20*c* by the bearing 8*c*. 21 represents a through bore drilled through the discs 20*a*, 20 and 20*b*. The bore 21 leads from the liquid reservoir 1 and ends in an axial gallery 10 formed in the disc 20*c*. A shaft seal 9 surrounds shaft 16 in the gallery 10 to prevent leakage of fluid beyond the disc 20*c*.

The spigot 11 is formed with an axial passage 22 which leads into the bore 21.

Figure 3:
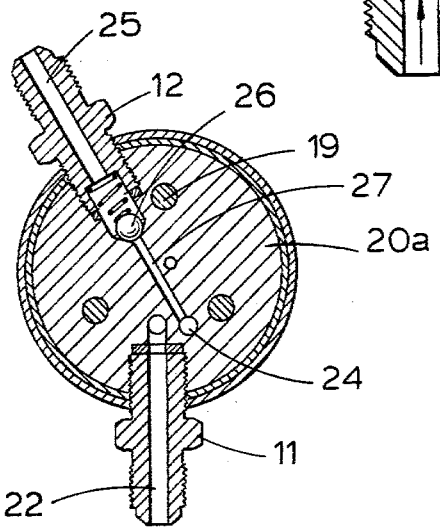
Figure 4:
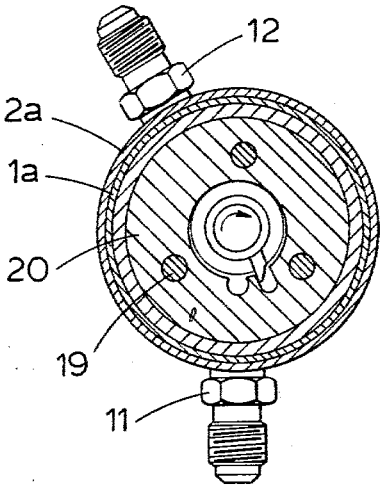

The spigot 12 has an axial passage 25 which communicates with a passage 27 (FIG. 3). The valve chamber contains a spring-loaded one-way ball valve 26.

Figure 2:
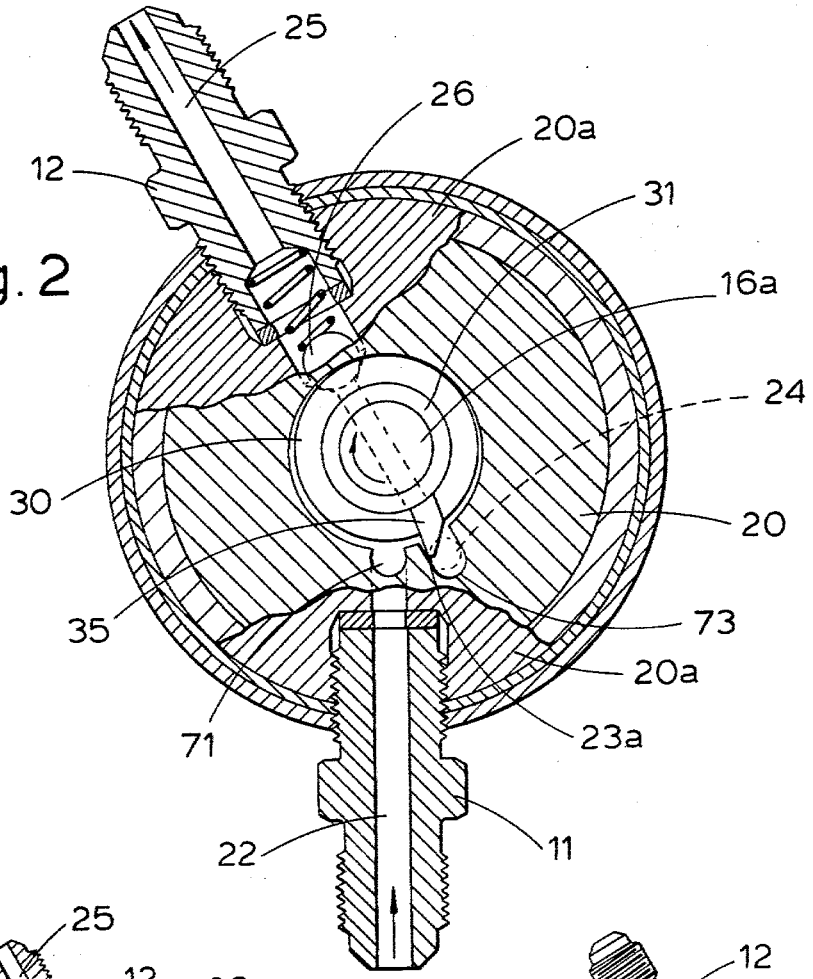
FIG. 2 is a composite cross-sectional view to larger scale taken on the lines III—III, IV—IV of FIG. 1; these sections being shown separately in FIGS. 3 and 4.

The shaft 16 has an offset crank 16*a* which appears on the cross-sectional view as shown in FIG. 2. The crank 16*a* rotates within the disc 20 which has plain end faces and an external cylindrical periphery. The disc 20 defines a central chamber having walls which are part cylindrical, the axis of the cylindrical part of the walls being coincident with the axis of the shaft 16, the axis of the crank part 16*a* being offset from this axis by a small distance corresponding to say 2% of the diameter of the chamber.

The cylindrical wall of the chamber is interrupted firstly by a recess 71 constituting an inlet duct and communicating with the bore 21 and the passage 22. Secondly the cylindrical wall is interrupted by a recess 73 with which communicates an outlet port 24 communicating by the passage 27 with the passage 25.

A cylindrical pumping sleeve 30 is located in the pump chamber and surrounds the crank 16*a*. The sleeve 30 has an outer cylindrical periphery which has a diameter slightly smaller than that of the cylindrical wall of the pump chamber formed within the disc 20.

A bronze bush 31 acts as a bearing between the crank 16*a* and the sleeve 30.

A tooth 35 projects radially from the sleeve 30 and engages in the recess 73. The tooth makes line contact with one straight wall 23*a* of the recess 23.

As the crank 16*a* is rotated, the tooth 35 engaged in the recess 23 prevents the sleeve 30 from also rotating. Instead, the sleeve 30 is caused by the crank to move eccentrically within the chamber as allowed by the clearance between its external periphery and the walls of the pump chamber. This eccentric movement is such that the crescent shaped clearance space existing between the sleeve periphery and the chamber wall rotates around the chamber, for example in the direction indicated by the arrow shown in FIG. 2 which corresponds to the direction of crank rotation.

It will be noted that in the arrangement shown the recess 73 communicating with the outlet port 24 is located some 330° in the direction of crank rotation from the recess 71 communicating with the bore 21. Liquid is drawn from the bore 21 through the inlet recess 71 and is impelled around the chamber walls by the rotating clearance space until it reaches the tooth 35 where it is deflected into the recess 73 and so into the outlet port 24. Sealing of the chamber defined by the disc 20 will be effected partly by metal-to-metal abutting faces clamped against the flat end surfaces on each side of the disc and partly by the bearings and the shaft seal 9 arranged on the crank shaft 16.

The inlet port 71 communicates with the reservoir 1, shown in FIG. 1, as well as with the passage 22, the latter conveniently serving as a low pressure return from a hydraulic system fed with high pressure through the outlet passage 25.

In one embodiment of the pump as illustrated in the accompanying drawings, the reservoir 1 has a capacity of 170 $cm^2$, the pump reservoir and motor assembled as shown in FIG. 1 having an overall length of 26.5 cm and the external diameter of the sleeve 2*a* is 5 cm. The cylindrical diameter of the pumping chamber is 16.25 mm and the centre of the crank 16*a* is offset from the axis of the shaft 16 by 0.368 mm. The shaft 16 is rotated at 2,750 revolutions per minute through the reduction gearing from the motor 2 whose output shaft rotates at between 12,000 and 13,000 revolutions per minute. Such a pump has been measured to transmit liquid at 200 $cm^3$ per minute at a pressure of at least 450 $N/cm^2$.

I claim:

1. A rotary hydraulic pump for delivering small volumes of liquid at a high pressure comprising: a housing defining a generally cylindrical pump chamber between axial end walls, said chamber being bounded radially by a cylindrical wall, two closely adjacent longitudinal recesses defined in said wall constituting inlet and outlet ducts of the chamber, a shaft passing axially through said end walls, offset means on the part of the shaft which is located within the chamber defining a crank, said outlet duct having planar parallel walls and an arcuate base tangentially joined to said planar walls, said inlet duct having an arcuate wall, said outlet duct arcuate base being essentially equal in size to said inlet duct so that said outlet duct is larger than said inlet duct, a cylindrical pumping sleeve surrounding the crank, means slidably connecting said sleeve to said crank so that said sleeve rotates with said crank but can slide therearound, said crank being mounted off the longitudinal centerline of said chamber so that said sleeve moves eccentrically within the chamber as said crank rotates so that the external cylindrical surface of the pumping sleeve cooperates with the cylindrical surface of the radial wall of the chamber to define a crescent-shaped clearance between said surfaces which rotates around the chamber as said crank rotates so that liquid introduced through the inlet duct into said chamber is impelled around said chamber towards the outlet duct, a tooth for preventing said sleeve from rotating as said sleeve moves eccentrically within said chamber, said tooth being connected at one end thereof to said sleeve and extending radially outward therefrom, said tooth extending into said outlet duct and having a planar wall making line contact with one of said outlet duct planar walls to inhibit rotation of said sleeve, said tooth bring sized to essentially completely close said outlet duct when said crank rotates said tooth into said outlet duct, said tooth having a planar top which is slanted toward said crank and away from said inlet duct to force fluid out of said outlet duct.

2. A pump according to claim 1 wherein said crank is offset from said shaft by an amount substantially equal to 2% of the diameter of the mainly cylindrical pumping chamber.

3. A pump according to claim 1 further including a connecting passage defined to extend radially through said housing and being fluidly connected at one end thereof to said outlet duct, an outlet passage defined to extend radially through said housing and being fluidly connected to another end of said connecting passage, and a spring-biased one-way ball valve positioned in said outlet passage to control flow therethrough.

4. A pump according to claim 3 further including a plurality of discs in said housing, means connecting said discs together, a bore defined through said discs wherein said connecting and said outlet passages are defined in one of said discs.

5. a pump according to claim 4 further including an outlet spigot mounted on said housing and having an outlet fluid bore defined therethrough to be in fluid communication with said outlet passage to receive fluid therefrom, an inlet spigot mounted in said housing and having an inlet fluid bore fluidly connected to said inlet duct.

6. A pump according to claim 5 further including a fluid reservoir in said housing, a motor in said housing wherein said inlet duct is in fluid communication with said reservoir and said shaft is connected to said motor to be rotated thereby.

7. A pump according to claim 6 further including reduction gearing connected to said shaft, the motor and gearing being located in said cylindrical housing and wherein the pump chamber is located in said cylindrical housing between the motor and the reservoir.

* * * * *